US007073431B1

(12) United States Patent
Chen

(10) Patent No.: US 7,073,431 B1
(45) Date of Patent: Jul. 11, 2006

(54) STRUCTURE PORTABLE STRAPPING MACHINE

(76) Inventor: Yu-Fu Chen, No. 49, U Twu Ku, Lin 9, Yeong Fu Li, Dah Shi City, Taoyuan (TW)

( * ) Notice: Subject to any disclaimer, the term of this patent is extended or adjusted under 35 U.S.C. 154(b) by 0 days.

(21) Appl. No.: 11/131,394

(22) Filed: May 18, 2005

(51) Int. Cl.
*B65B 13/18* (2006.01)

(52) U.S. Cl. ..... 100/29; 100/33 PB; 53/592; 156/580; 156/494

(58) Field of Classification Search ..... 100/29, 100/30, 32, 33 R, 33 PB; 53/582, 590, 592; 156/494, 502, 580, 581, 583.1, 353; 24/68 R, 24/69 TM, 69 ST
See application file for complete search history.

(56) References Cited

U.S. PATENT DOCUMENTS 4,450,032 A * 5/1984 Wehr ..... 156/353
5,689,943 A * 11/1997 Wehr ..... 53/592
6,109,325 A * 8/2000 Chang ..... 156/494

* cited by examiner

*Primary Examiner*—Derris H. Banks
*Assistant Examiner*—Jimmy T. Nguyen
(74) *Attorney, Agent, or Firm*—Rosenberg, Klein & Lee

(57) ABSTRACT

An improved structure portable strapping machine in which a band is articulated via a strap pulling device, a swinging device, and a cutting device and then bound tight by a friction welding means to facilitate strapping objects of various shapes and dimensions that are difficult to ship. As such, utilization of the improved structure portable strapping machine of the present invention is easy, convenient, rapid, reliable, and safe.

2 Claims, 9 Drawing Sheets

STRUCTURE PORTABLE STRAPPING MACHINE

BACKGROUND OF THE INVENTION

1) Field of the Invention

The invention herein relates to an improved structure portable strapping machine of simple arrangement that is easy and convenient to utilize for strapping heavy or large objects which are difficult to ship, the improved structure strapping device of the present invention thereby providing for greater ease, convenience, speed, and reliability.

2) Description of the Prior Art

The conventional means of securely strapping difficult-to-ship, large dimension or heavy packaged objects typically consists of a wrapping a steel band with a portable, manually operated tool. While such an approach effectively achieves the strapping of packaged objects, said steel band has the disadvantages of high cost, excessive weight, and injury hazards. Furthermore, since such steel band strapping tools are operated by hand, work efficiency is low and operation is troublesome, inconvenient, and laborious.

SUMMARY OF THE INVENTION

The primary objective of the invention herein is to provide an improved structure portable strapping machine in which after a PET plastic band is wrapped around a strapped object, since it is drawn taut by a strap pulling device and then a swinging device applies pressure and rapidly sways against the top layer of the overlaid section, the overlaid section of said band is welded into a single structural entity by heat generated by high-speed friction, thereby ensuring easy, convenient, rapid, and safe strapping operation.

Another objective of the invention herein is to provide an improved structure portable strapping machine in which a cutting device blade consists of a saw-toothed cutting edge and, furthermore, when the swinging device applies downward pressure on the band and the top layer surface of the band overlaid section is tensively contacted and pressed, said band overlaid section is subjected to the swinging device and its high-speed reciprocal swaying such that the saw-toothed cutting edge of said blade rapidly and, furthermore, efficiently cuts the band without affecting the stationary condition of the bottom layer.

DETAILED DESCRIPTION OF THE PREFERRED EMBODIMENT

Figure 1:
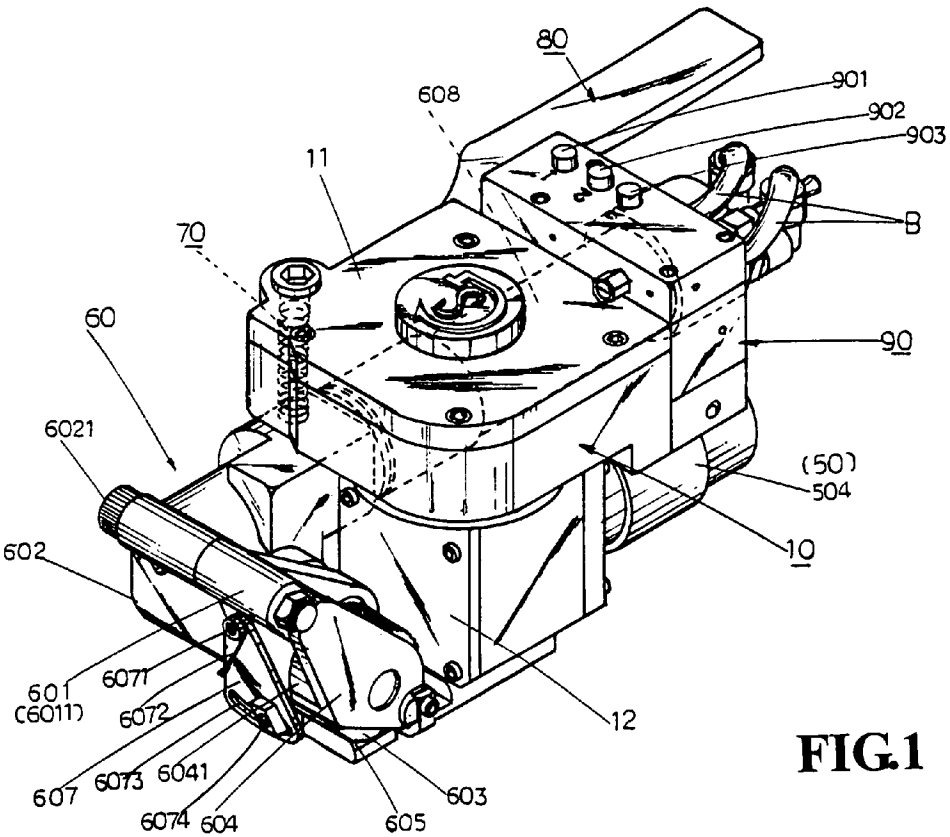
FIG. 1 is an isometric drawing of an embodiment of the invention herein.
Figure 2:
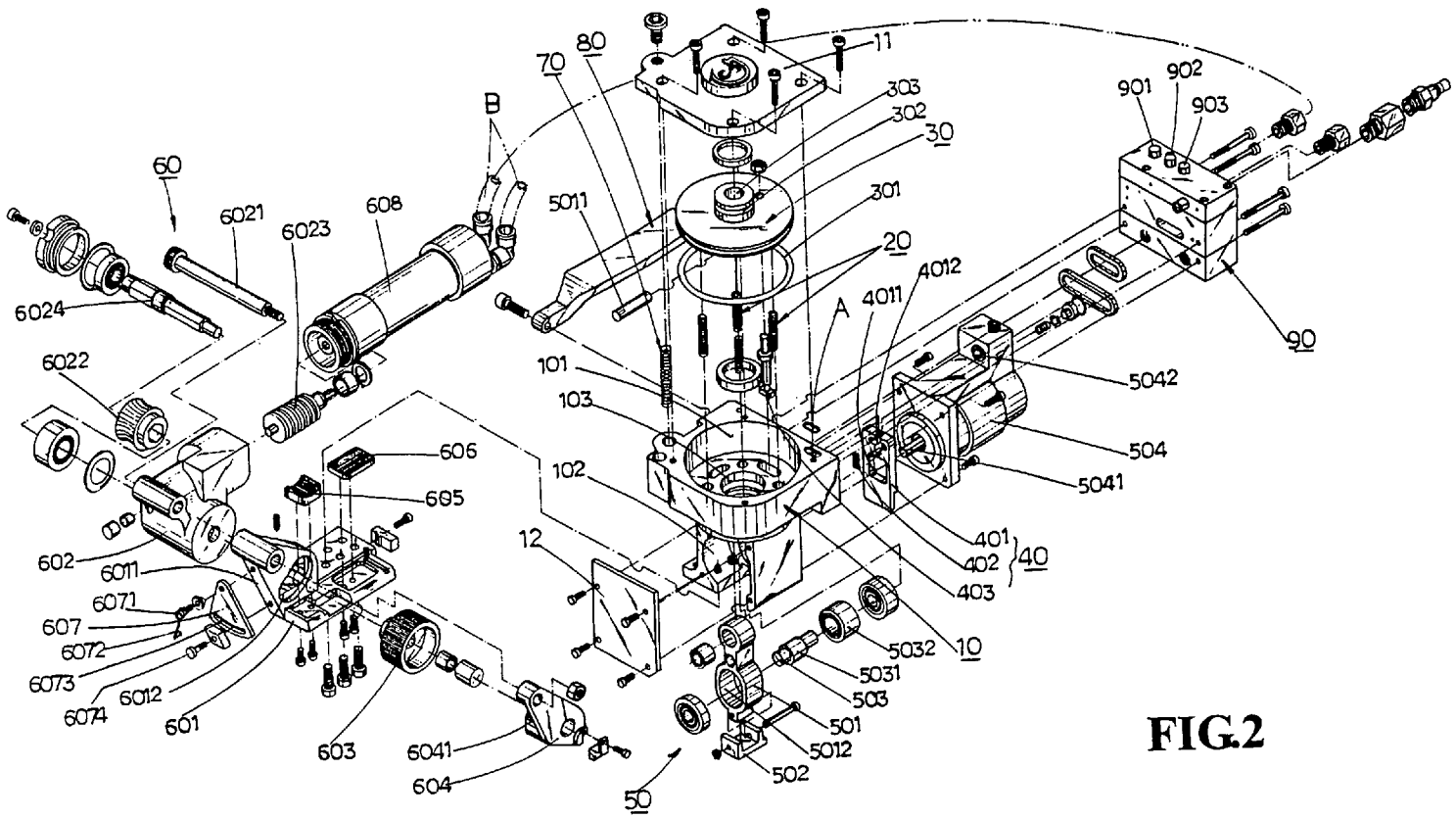
FIG. 2 is an exploded drawing of an embodiment of the invention herein.
Figure 3:
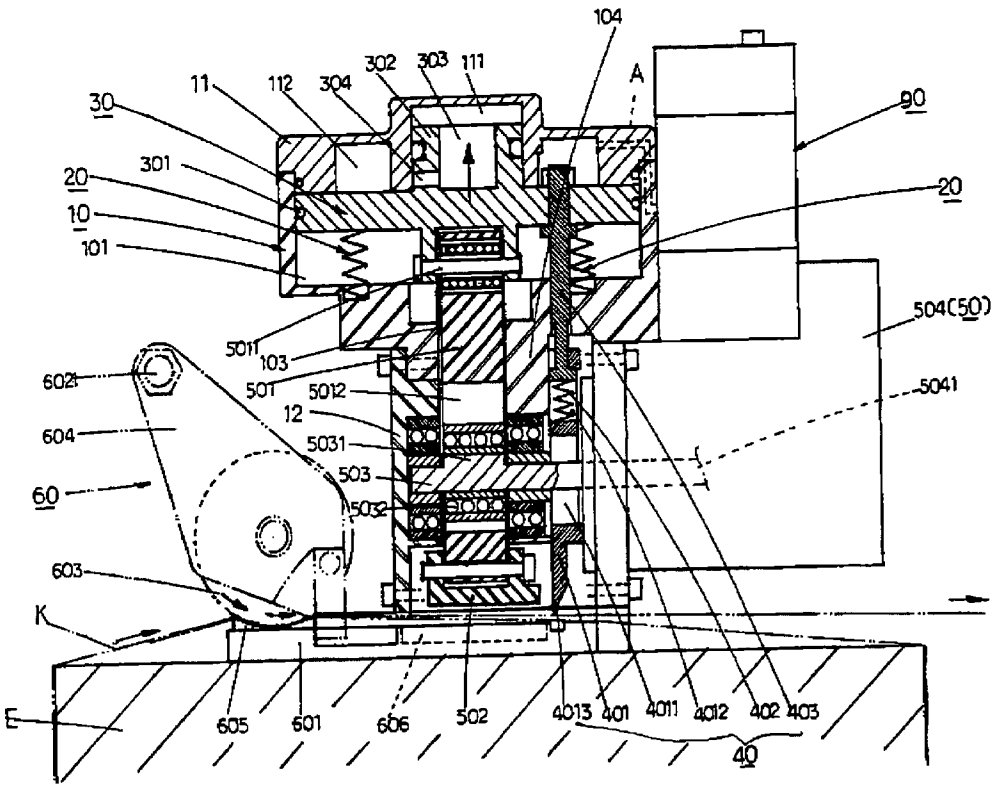
FIG. 3 is a cross-sectional drawing of the piston of the invention herein ascending to the top dead center point during the strapping operation.

Referring to FIG. 1, FIG. 2, and FIG. 3, the improved structure portable strapping machine of the invention herein is comprised of:

A main body 10 having a cylinder 101 at its upper end, and an open, downward oriented passage 102 at its lower end, a guide hole 103 contiguously disposed between said cylinder 101 and passage 102, and an outer cover 11 attached to its top section, wherein said outer cover 11 has a sleeve hole 111 at the center and an air chamber 112 is formed around the sleeve hole 111.

A plurality of elastic components 20 installed inside the cylinder 101 at the upper end of the main body 10.

A piston component 30 fitted into the cylinder 101 at the upper end of the main body 10 by means of a sealing ring 301 and resiliently supported upward at the lower end by the elastic components 20, a locating post 302 projecting upward from the center, said locating post 302 also capable of sliding in the sleeve hole 111 of the outer cover 11 at the main body 10 top end, a blind hole 303 at the center, and an air guide hole 304 disposed at the lower end of said blind hole 303 that is in continuity with the exterior.

A cutting device 40 consisting of a blade 401 that slides along one side wall 104 at the lower end of the main body 10, a large through-hole 4011 disposed in the center section, a locating slot 4012 near the upper end, and a saw-toothed cutting edge 4013 along the bottom end; an elastic component 402 installed in the locating slot 4012 near the top end of the blade 401; a drive rod 403, the upper end of which is attached to the piston 30 with the lower end inserted through the locating slot 4012 near the upper end of the blade 401 and supported by the elastic component 402 such that tensive downward pressure is always applied to the blade 401.

A swinging device 50 consisting of a rocker arm 501 situated in the passage 102 at the lower end of the main body 10 and concealed inside a side cover 12 disposed lateral to the lower end of the main body 10, the upper extremity of which is inserted into the main body 10 guide hole 103 and hinged to a locating pin 5011 at the piston 30, and an elongated guide hole 5012 formed near the lower extremity; an upper friction block 502 capable of swaying to the left and right that is hinged to the lower extremity of the rocker arm 501; an eccentric rod 503, the eccentric section 5031 at the middle portion of which is situated at the elongated guide hole 5012 near the lower extremity of the rocker arm 501, with a bearing 5032 installed against its circumferential surface via the elongated guide hole 5012 such its two ends are in a pivotable state at the side cover 12 at the lower end of the main body 10 and the side wall 104; a drive motor 504 situated at the exterior lateral extent of the side wall 104 at the lower end of the main body 10 and aligned over the cutting device 40 blade 401, the center shaft 5041 of which penetrates the blade 401 through-hole 4011 and is then installed to the eccentric rod 503 such that the rotation of the eccentric rod 503 causes the leftward and rightward swaying of the rocker arm 501 and the upper friction block 502 installed at the lower extremity of the rocker arm 501.

A strap pulling device 60 consisting of a base 601 situated at the bottom section of the main base 10 that has a locating arm 6011 extending upward from one side and an arcuate guide hole 6012 formed at the lower extent of the locating arm 6011; a gear box 602 that includes a screw 6021 capable of swaying upward and downward which is insertionally positioned at the locating arm 6011 at one side of the base 601 and enmeshed with an internally disposed worm gear 6022 and worm shaft 6023, wherein said locating worm gear 6022 shaft 6024 is also inserted through the locating arm 6011 arcuate guide hole 6012; a strap puller wheel 603 at the opposite side and upper extent of the base 601 situated with the worm gear 6022 on the same shaft 6024; a gear box side mount 604 situated with the gear box 602 on the same screw 6021 insertionally positioned at the base 601 locating arm 6011, the lower end of which provides for the insertional positioning of a worm gear 6022 as well as a strap puller wheel 603 shaft 6024, and a side cover 6041 over the anterior upper extent of the strap puller wheel 603; an anti-slip block 605 installed at the base 601 aligned with the puller wheel 603; a lower friction block 606 installed at the base 601 aligned with the swinging device 50 upper friction block 502; a strapping plate 607, the upper end of which is pivotably installed on the surface at the front end of the base locating arm 6011 with a locating screw 6071 and capable of swaying freely having an elastic component 6072 (can be a return spring) at the locating screw 6071, with one end of said elastic component 6072 resting against inner side of the strapping plate 607 such that the strapping plate 607 is always subjected to tensive force towards the strap puller wheel 603 and a horizontally oriented arcuate slot 6073 is formed in the lower end, said horizontally oriented arcuate slot 6073 providing for the insertion of a screw 6074 that is fastened to the surface at the front end of the base locating arm 6011; and a strap puller motor 608 of long tubular shape installed at one end of the gear box 602 that directly drives the worm shaft 6023 and enables the rotation of the enmeshed worm gear 6022, the shaft 6024, and the strap puller wheel 603.

An elastic component 70 installed at one side of the main body 10, the lower end of which directly supports the surface at the upper end of the gear box 602 such that the strap puller motor 608, the gear box 602, the strap puller wheel 603, and the gear box side mount 604 are always subjected to tensive downward pressure via the fulcrum of the base 601 locating arm 6011.

A handle 80 disposed at one side of the main base 10 and situated at the upper extent of the long tubular-shaped strap puller motor 608 that provides for the manual upward and downward turning of the strap puller motor 608, the gear box 602, the strap puller wheel 603, and the gear box side mount 604.

An air pressure control valve 90 installed at the rear end of the main base 10 that is controlled by a plurality of switches 901, 902, and 903, through which compressed air is respectively conveyed to a main body 1 air duct A (see FIG. 3), a drive motor 504 air intake port 5042 (see FIG. 2), and a strap puller motor 608 air pipe B to the air chamber 112 in the outer cover 11 at the upper end of the main body 10, the swinging device 50 drive motor 504, and the strap pulling device 60 strap puller motor 608, thereby controlling the operation of the cutting device 40, the swinging device 50, and the strap pulling device 60.

Figure 4:
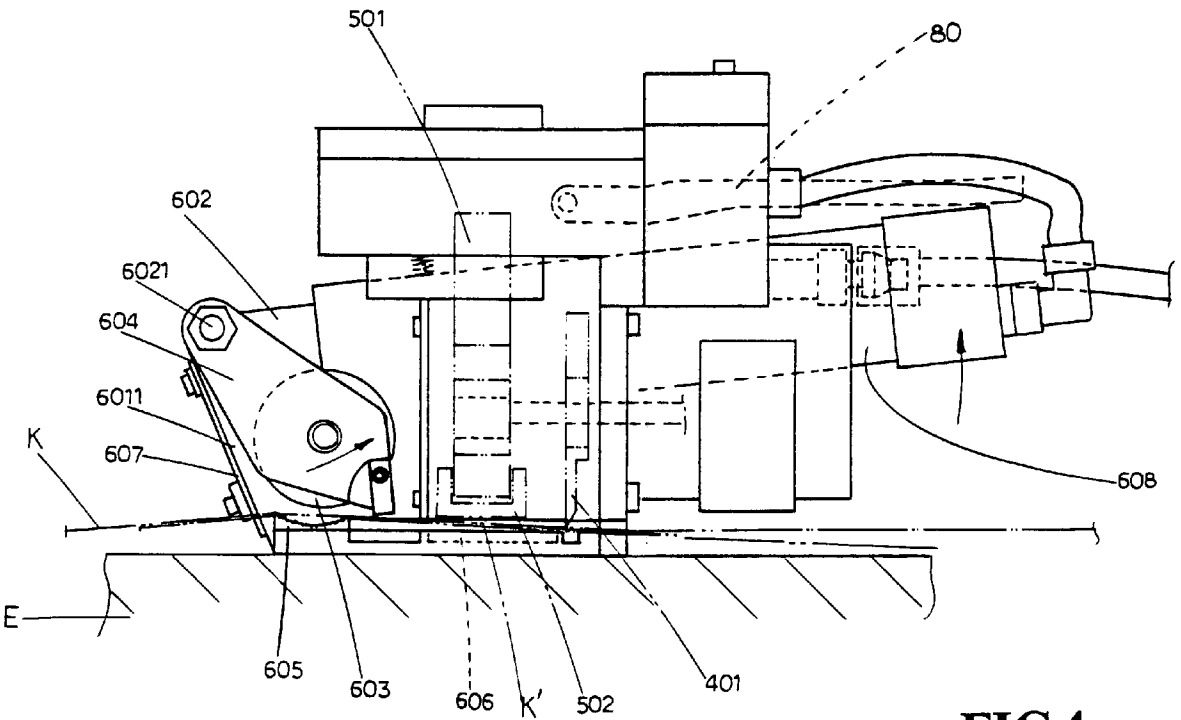
FIG. 4 is an orthographic drawing of the strap puller motor of the invention herein turning upward during the strapping operation.
Figure 5:
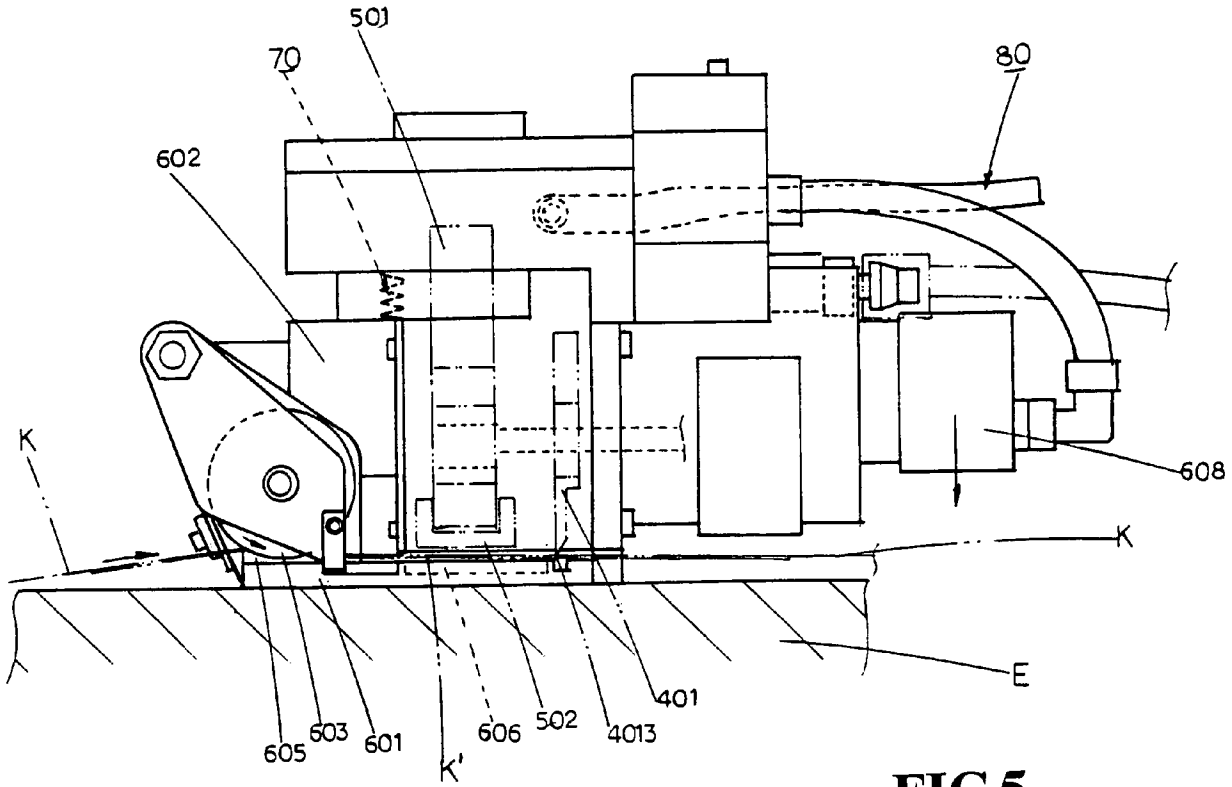
FIG. 5 is an orthographic drawing of the strap puller motor of the invention herein in the down position during the strapping operation.
Figure 6:
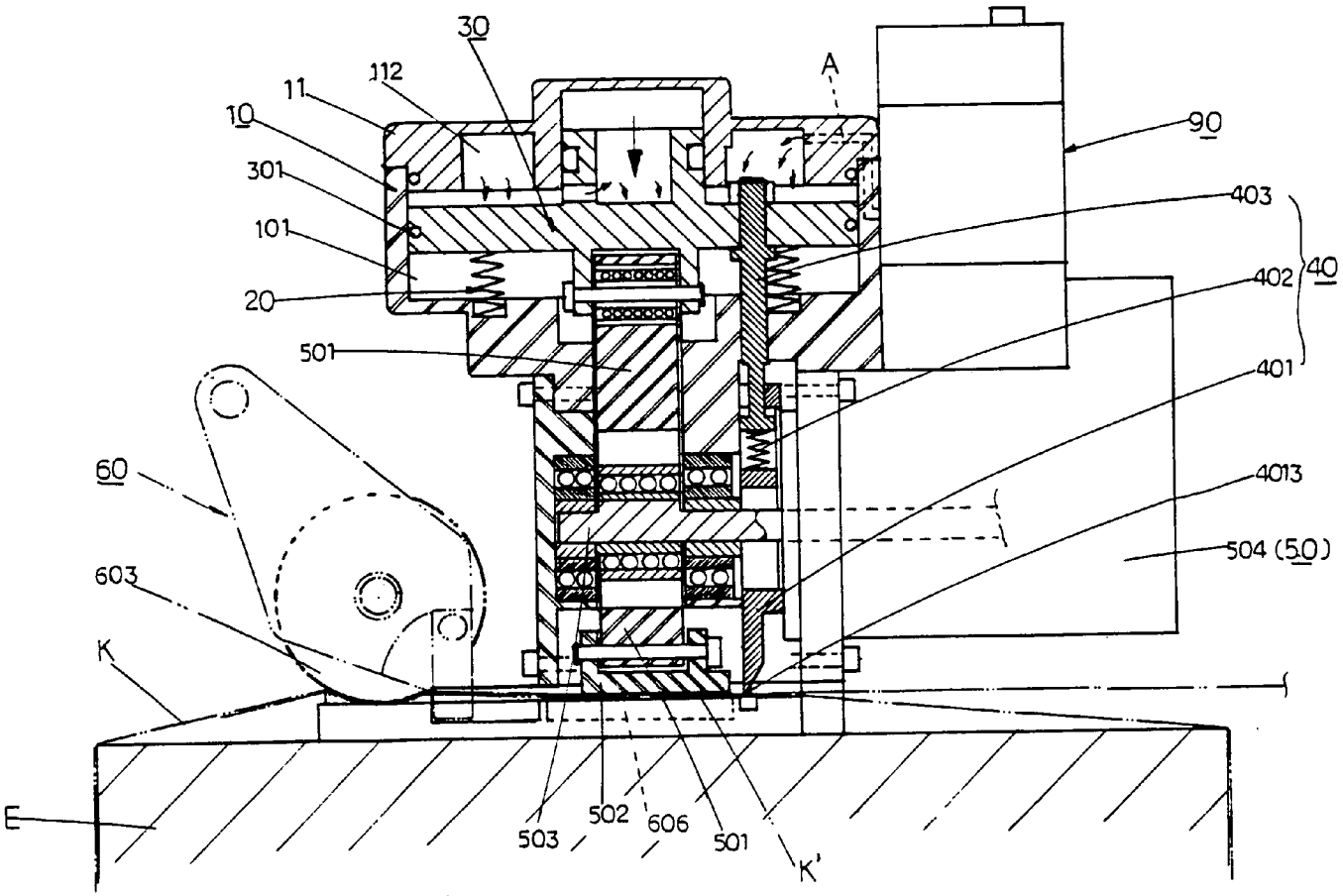
FIG. 6 is a cross-sectional drawing of the piston of the invention herein descending during the strapping operation.

Utilizing said structure of the invention herein, referring again to FIG. 4, after the operator wraps a PET plastic band K around a strapped object E, the thumb of one hand is placed on the handle 80 and the remaining four fingers grasp the strap pulling device 60 strap puller motor 608 to turn it upward, causing said strap pulling device 60 gear box 602, strap puller wheel 603, and gear box side mount 604 to each travel upward on the screw 6021 serving as the axial point at the base locating arm 6011 such that said strap puller wheel 603 is swung upward, following which a large interval results due to its disengaged enmeshment from the anti-slip block 605; utilizing said piston 30 that is normally subject to the decompression of the elastic components 20 and thereby shoved upward to the top dead center point, the upper friction block 502 of said swinging device 50 rocker arm 501 and the blade 401 of the cutting device 40 drive rod 403 are lifted into a retracted state, the operator then directly inserts the overlaid section K' of the band K wrapped around the strapped object E into one side of the strap pulling device 60 base 601, thereby positioning it at the lower extent of the strap puller wheel 603, the upper friction block 502, and the blade 401; referring to FIG. 5 and FIG. 6, after the band K overlaid section K' is definitely positioned at the lower extent of the strap puller wheel 603, the upper friction block 502, and the blade 401, the operator lowers the strap puller motor 608, causing said strap puller wheel 603 to exert downward pressure on the band K and utilizing the elastic component 70 installed at one side of said main body 10 that always exerts tensive pressure against the upper end of the strap pulling device 60 gear box 602, when said strap puller motor 608 lowered such that the strap puller wheel 603 is pressed down, the overlaid section K' is subjected to elastic pressure and directly clutched by the strap puller wheel 603 and the anti-slip block 605; when the operator presses the first switch 901 of the air pressure control valve 90 and thereby causes compressed air to power the strap pulling device 60 strap puller motor 608, the motive force is transferred via the worm shaft 6023, the worm gear 6022, and the shaft 6024 to the strap puller wheel 603 such that the top layer of the overlaid section K' is directly contacted and pressed by the strap puller wheel 603 and thereby drawn and shifted tight; after band K winding operation around the strapped object E is completed, the operator releases the first switch 901 of the air pressure control valve 90 and next presses the second switch 902, causing said compressed air to simultaneously enter the air chamber 112 (see FIG. 6) in the outer cover 11 of the main body 10 to power the swinging device 50 drive motor 504 as well as the main body cylinder 101 to provide compression for the downward movement of the piston 30 inside, thereby pressing down the upper friction block 502 of swinging device 50 rocker arm 501 hinged at its lower end such that after its said downward movement, the upper friction block 502 tensively contacts the top layer of the overlaid section K' and, at the same time, the motive force of the eccentric rod 503 powered by drive motor 504 is transferred to the rocker arm 501 such that the upper friction block 502 hinged to the lower end of said rocker arm 501 is impelled to sway rapidly to the left and the right, the rapid rubbing of the overlaid section K' top layer by the upper friction block 502 generating high heat that directly welds it to the overlaid bottom layer into a single structural entity.

In said description, when the cylinder 30 is impelled downward and the swinging device 50 welds the band K overlaid section K', since said cutting device 40 drive rod 403 is similarly attached to the cylinder 30 and moves down with it, and the blade 401 insertionally positioned at the drive rod 403 is supported by the elastic component 402 and also capable of moving downward under tensive pressure to contact the top layer of the band K overlaid section K', since the blade 401 cutting edge 4013 is saw-toothed, and said top layer of the band K overlaid section K' is subjected to the swaying operation of the swinging device 50 upper friction block 502 and the consequent rapid leftward and rightward rubbing, the saw-toothed edge of the blade 401 rapidly and, furthermore, reliably cuts the top layer of the band K overlaid section K', enabling the wrapping of the strapped object E. Of course, since the bottom layer of the band K overlaid section K' is not impelled by the swinging device 50 upper friction block 502, tightness is maintained and it remains fixed, said blade 401 not having any cutting effect on the fixed lower layer band K, thereby ensuring the strapping integrity of the band K.

After the welding and cutting of the band K wrapped wound around the strapped object E, the operator releases the second switch 902 of the air pressure control valve 90 and next presses the third switch 903 and since the swinging device 50 drive motor 504 is thereafter no longer driven and air is discharged from the air chamber 112 in the outer cover 11 of the main body, as indicated in FIG. 3, said cylinder 30 is resiliently returned by the elastic component 20, the upper friction block 502 and the cutting device 40 blade 401 also moving upward and returning away from the strapping band K.

Figure 7:
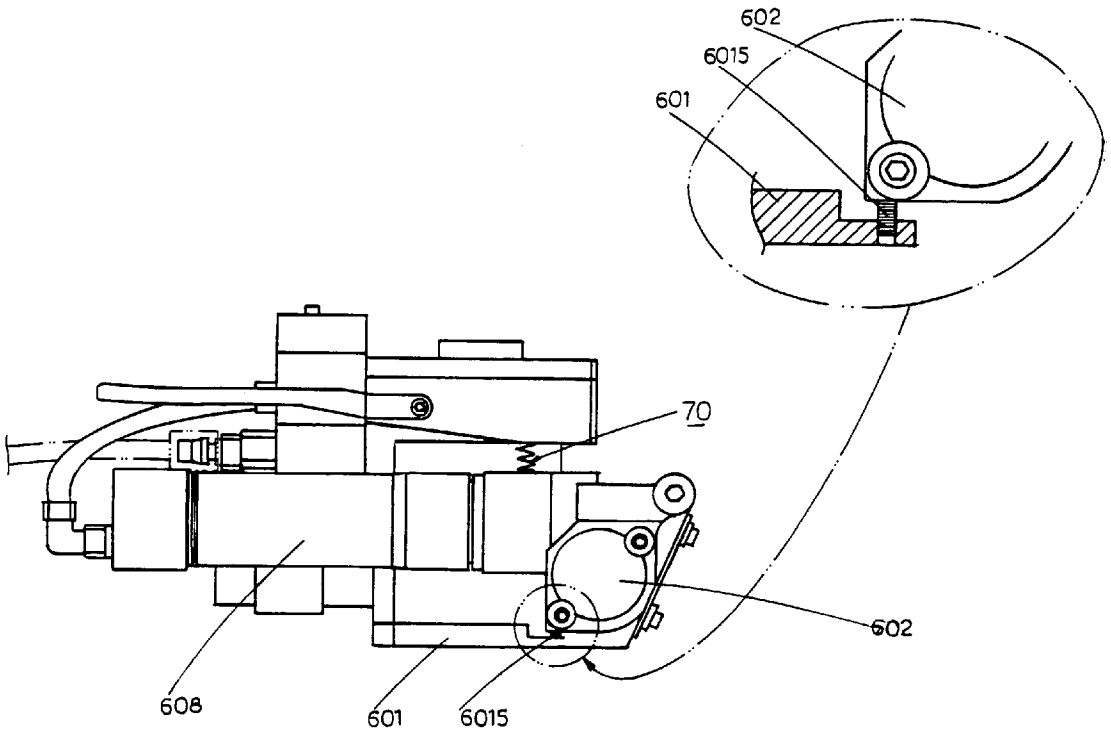
FIG. 7 is an orthographic drawing of the adjustment screw of the invention herein against the gear box bottom section.

Referring to FIG. 7, an adjustment screw 6015 is installed in the bottom section at one side of said strap pulling device 60 base 601, with the exposed said adjustment screw 6015 against the gear box 602 bottom section capable of high and low adjustment such that when the operator releases the strap puller motor 608 and the gear box 602 as well as the strap puller wheel 603 such that both are pressed downward, the exposed height adjustment of said adjustment screw 6015 causes the gear box 602 and the strap puller wheel 603 to be pressed downward a certain range, enabling the strap puller wheel 603 to reach an optimal height to contact the band K such that the band K is reliably and efficiently drawn taut. In other words, due to the high and low adjustment operation of said adjustment screw 6015, said strap puller wheel 603 can be articulated to the best height for contacting the band K, thereby reliably and efficiently enabling bands K of various thickness to become pulled tight.

Figure 9:
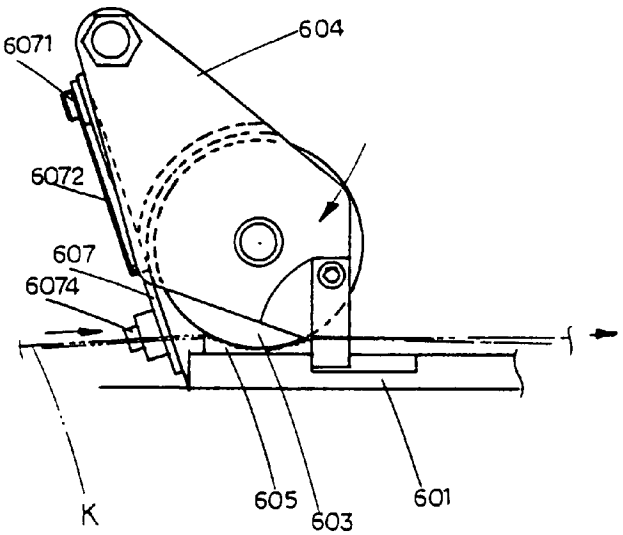
FIG. 9 is an orthographic drawing of FIG. 8, as viewed from a lateral perspective.
Figure 8:
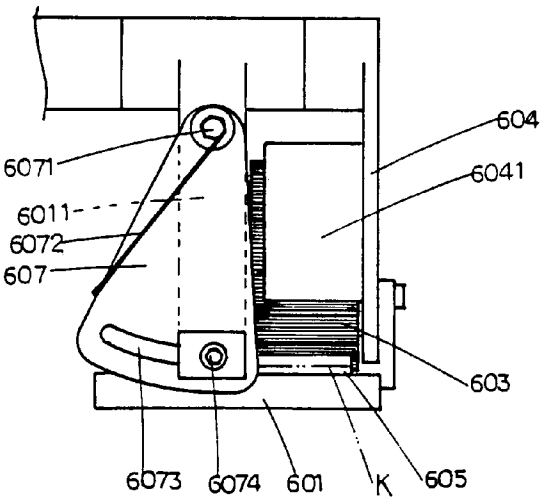
FIG. 8 is an orthographic drawing of the strapping plate of the invention herein being pushed by the inside of the strap.
Figure 11:
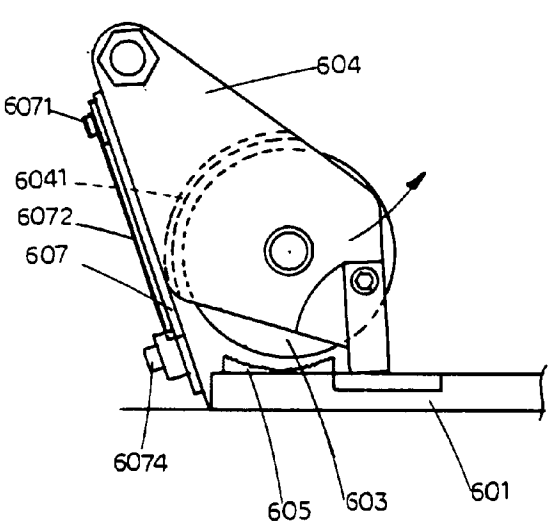
FIG. 11 is an orthographic drawing of FIG. 10, as viewed from a lateral perspective.
Figure 10:
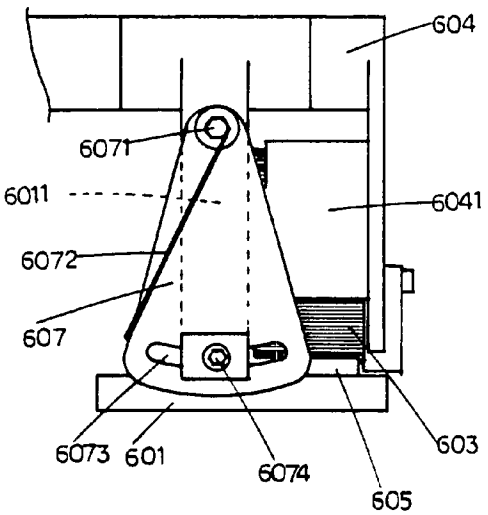
FIG. 10 is an orthographic drawing of the strapping plate of the invention herein stopped at the outer cover of the gear box side mount.

Referring to FIG. 8 and FIG. 9, since the strapping plate 607 installed on the surface at the front end of the base 601 locating arm 6011 is subjected to the tensive force of the elastic component 6072 and always subjected to tensive force towards the strap puller wheel 603, when the band K wrapped around the strapped object E is pulled into the strap pulling device 60 base and situated at the lower extent of the strap puller wheel 603, the elastically loaded strapping plate 607 is directly pushed inward by the band K with a locating screw 6071 serving as the axial point, thereby fully impelling the strap puller wheel 603 to the band K. Conversely, referring to FIG. 10 and FIG. 11, when the strap puller motor 608 is turned upward and consequently nudges the strap puller wheel 603 up such that it is disengaged from enmeshment with the anti-slip block 605 and the band K does not enter the lower extent of the strap puller wheel 603, since said strapping plate 607 is always elastically pressured towards the strap puller wheel 603, it is not pushed inward by the band K and gear box side mount 604 rises upward, but automatically elastically pressured towards the strap puller wheel 603 and, furthermore, stopped at the gear box side mount 604 side cover 6041 area such that the strap puller wheel 603 along the same axis as the gear box side mount 604 cannot go downward, furthermore, the strap puller wheel 603 is disengaged from enmeshment with anti-slip block 605, thereby precluding unintentional contact with the air pressure control valve 90 first switch 901 such that when the strap puller motor 608 is driven, direct abrasion and damage cannot occur between said strap puller wheel 603 and the anti-slip block 605.

Of course, since the horizontally oriented arcuate slot 6073 is formed in the lower end of said strapping plate 607, as per actual utilization requirements, the user can tighten it with the screw 6074 to achieve the most suitable positioning and thereby maintain stationary placement.

What is claimed is:

1. An improved structure portable strapping machine comprised of:

a main body having a cylinder at an upper end, an open and downwardly oriented passage at a lower end, a guide hole contiguously disposed between said cylinder and said passage, and an outer cover attached to a top section of said main body, wherein said outer cover has a sleeve hole at a center thereof and an air chamber is formed around said sleeve hole;

a plurality of elastic components installed inside said cylinder at the upper end of said main body;

a piston component situated in a sealed state within said cylinder at the upper end of said main body and resiliently supported upwardly at the lower end by said elastic components and a locating post projecting upward from the center, said locating post being slidable in said sleeve hole of said outer cover at the upper end of said main body;

a cutting device consisting of a blade that slides along one side wall at the lower end of said main body, a large through-hole disposed in a center section of the blade, a locating slot near an upper end of the blade, and a saw-toothed cutting edge along a bottom end of the blade; an elastic component installed in said locating slot near the top end of said blade; a drive rod having an upper end attached to said piston with a lower end of the drive rod inserted through said locating slot near the upper end of said blade and supported by said elastic component such that tensive downward pressure is always applied to said blade;

a swinging device consisting of a rocker arm situated in said passage at the lower end of said main body and concealed inside a side cover disposed lateral to the lower end of said main body, an upper extremity of said rocker arm being inserted into said main body guide hole and hinged to a locating pin at said piston, and an elongated guide hole being formed near a lower extremity of said rocker arm; an upper friction block being hinged to the lower extremity of said rocker arm; an eccentric rod having an eccentric section at a middle portion thereof being situated at said elongated guide hole near the lower extremity of said rocker arm; a drive motor situated at an exterior lateral extent of said side wall at the lower end of said main body and aligned over said cutting device blade, the drive motor having a center shaft that penetrates said blade through-hole and is then installed to said eccentric rod such that the rotation of said eccentric rod causes a leftward and rightward swaying of said upper friction block installed at the lower extremity of said rocker arm;

a strap pulling device consisting of a base situated at the a bottom section of said main body and having a locating arm extending upwardly from one side and an arcuate guide hole formed at a lower extent of said locating arm; a gear box including a screw extending through said locating arm at one side of said base, and an internally disposed worm gear enmeshed with a worm shaft, wherein a shaft of said worm gear is also inserted through said locating arm arcuate guide hole; a strap puller wheel at an opposite side and upper extent of said base being situated with said worm gear on said shaft of said worm gear; a gear box side mount being situated with said gear box on said screw extending through said locating arm, a lower end of said gear box side mount providing for the insertional positioning of said worm gear as well as said strap puller wheel shaft, and a side cover over an anterior upper extent of said strap puller wheel; an anti-slip block installed at said base aligned with said swinging device upper friction block; a lower fiction block installed at said base aligned with said swinging device upper friction block; a strap puller motor of long tubular shape being installed at one end of said gear box that directly drives said worm shaft and enables rotation of the enmeshed said worm gear, the shaft, and the strap puller wheel;

an elastic component installed at one side of said main body and having a lower end directly supporting a surface at an upper end of said gear box such that said strap puller motor, said gear box, said strap puller wheel, and said gear box side mount are always subjected to tensive downward pressure via a fulcrum of said base locating arm;

a handle disposed at one side of said main body and situated at an upper extent of the long tubular shaped of said strap puller motor that provides for the manual upward and downward turning of said strap puller motor, said gear box, said strap puller wheel and said gear box side mount;

an air pressure control valve installed at a rear end of the said main body being controlled by a plurality of switches through which compressed air is respectively conveyed to an air duct of said main body, an air intake port of said drive motor, and an air pipe of said strap puller motor to said air chamber in said outer cover at the upper end of said main body, said swinging device drive motor, and said strap pulling device strap puller motor, thereby controlling operation of said cutting device, said swinging device, and said strap pulling device;

said strap pulling device has a strapping plate, an upper end of said strapping plate being pivotally installed on a surface at a front end of said base locating arm and being freely swayable, and always subjected to the tensive force of an elastic component towards said strap puller wheel, and a horizontally oriented arcuate slot being formed in a lower end of said strapping plate, said horizontally oriented arcuate slot providing for the insertion of a screw that is fastened to said locating arm.

2. An improved structure portable strapping machine as claimed in claim 1 wherein said strap pulling device strap puller motor is brought upward to said strap puller wheel, said strapping plate stops at a position of said side cover of said gear box side mount.

* * * * *